US005149259A

United States Patent [19]

Greco

[11] Patent Number: 5,149,259

[45] Date of Patent: Sep. 22, 1992

[54] GRATELESS REGENERATIVE INCINERATOR

[75] Inventor: Richard J. Greco, Matawan, N.J.

[73] Assignee: JWP Air Technologies, Mountainside, N.J.

[21] Appl. No.: 783,554

[22] Filed: Oct. 28, 1991

[51] Int. Cl.[5] ..... F23D 14/00; F23G 7/08

[52] U.S. Cl. ..... 431/5; 110/212; 165/4; 422/175; 431/170

[58] Field of Search ..... 431/5, 170; 432/72, 432/180, 181, 182; 165/6, 4, 10; 110/211, 212; 422/175, 182

[56] References Cited

U.S. PATENT DOCUMENTS 4,474,118 10/1984 Benedick ..... 431/5 X 4,850,862 7/1989 Bjerklie ..... 431/170 X

*Primary Examiner*—Edward G. Favors

*Attorney, Agent, or Firm*—Dykema Gossett

[57] ABSTRACT

A grateless regenerative incinerator includes a gas distribution assembly having a plurality of tubes supported adjacent the floor of a heat exchanger. A coarse heat exchange material covers the tubes, and a fine heat exchange material covers the coarse material, filling the remainder of the heat exchange chamber. Gases enter and leave the heat exchange chamber through the tubes.

17 Claims, 2 Drawing Sheets

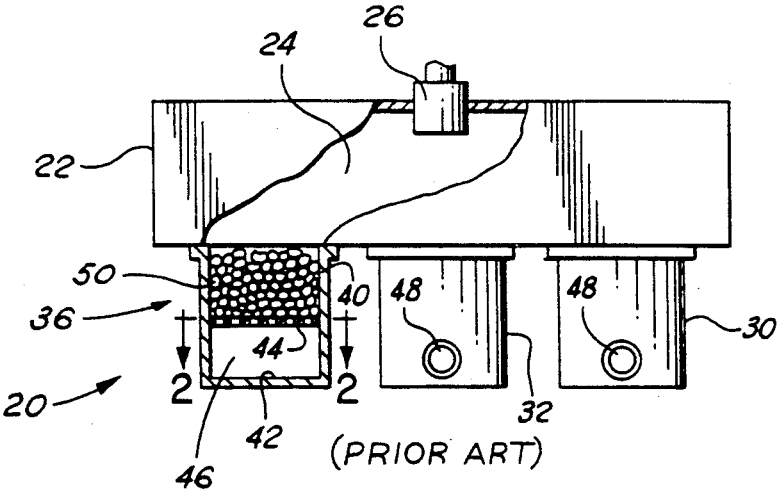
FIG. 1
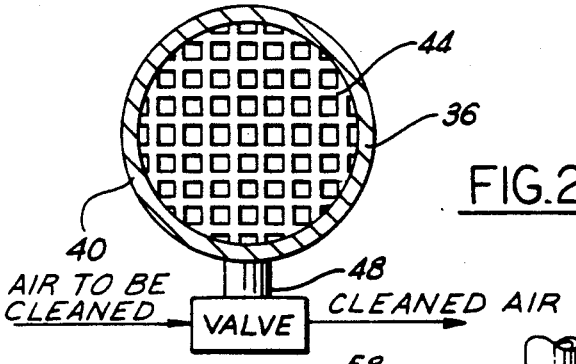
FIG. 2
FIG. 3
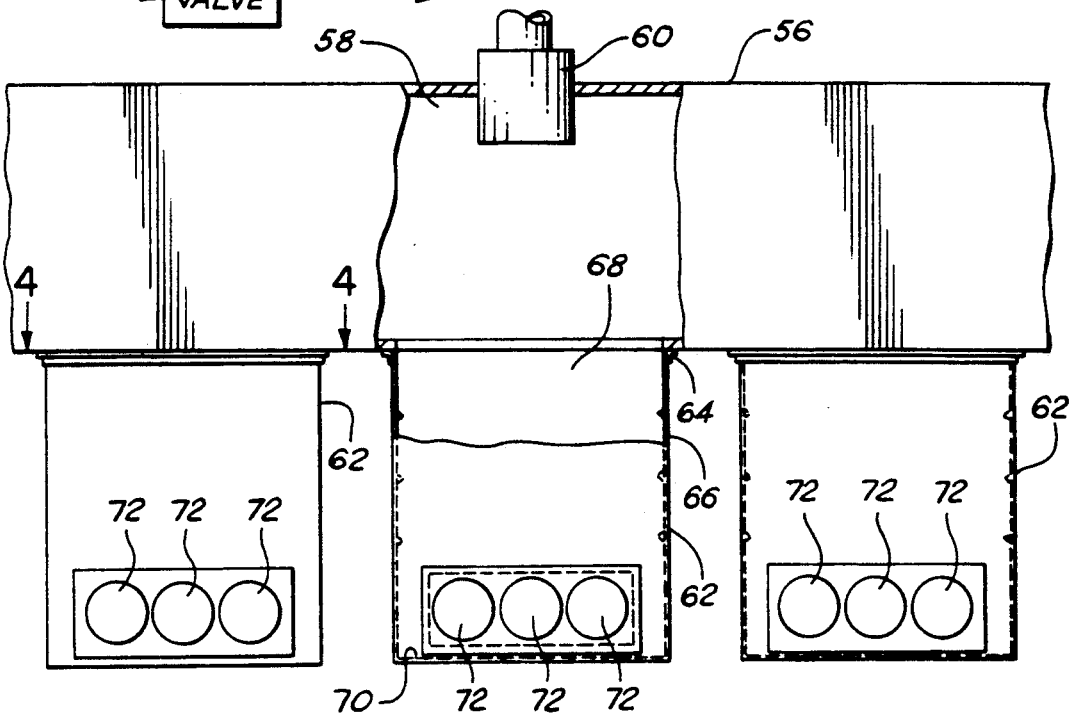

GRATELESS REGENERATIVE INCINERATOR

TECHNICAL FIELD

The present invention relates generally to regenerative incinerators of the type in which impurities are removed from a gas stream by combustion. More specifically, the present invention relates to gas distribution and ceramic bed structures for heat exchangers in such regenerative incinerators.

BACKGROUND OF THE INVENTION

Impurities may become entrained in a gas stream as a result of certain industrial operations. These impurities could be broadly termed volatile organic compounds ("VOC"). Since the gas, such as air, used in the industrial operation may have to be recycled or exhausted to atmosphere, it becomes important to remove VOC from the gas. There are strict regulations that mandate maximum VOC levels in air which is exhausted from industrial exhaust stacks. The pollution equipment for combusting, and hence removing, VOC has become quite sophisticated over the past several years. Every feature of the equipment design is optimized to reduce power usage, and increase cleaning efficiency.

A regenerative incinerator of the type addressed in this patent application can generally be defined as a system which maximizes VOC destruction at the lowest possible cost in terms of energy requirements. This is achieved by integrating three fundamental steps: a VOC-laden gas stream is preheated to a temperature near its combustion point; the VOCs are oxidized by a combustion flame; and heat is removed from the hot purified gases in which the VOCs have been oxidized, and used to preheat subsequent incoming VOC-laden gases. This basic process has proven to be an efficient method of VOC destruction.

A number of regenerative incinerators are known which utilize this basic process for VOC destruction. These systems are generally characterized by a plurality of heat exchangers connected to a common combustion chamber, in which a gas burner is positioned. Each heat exchange chamber includes at least one port through which a gas stream flows during operation. In addition, each heat exchange chamber is packed with a heat exchange material which serve to transfer heat between cool, incoming gases to be cleaned and hot, outgoing cleaned gases.

In a typical operation, VOC-laden gases are directed into a first heat exchange chamber such that they flow through the chamber in contact with the heat exchange material and toward the common combustion chamber. In the common combustion chamber the VOCs are oxidized by the flame from the gas burner. After combustion, the purified gas stream contains a substantial amount of heat energy which would be lost if the purified gases were simply vented to atmosphere. Instead, the heat is regenerated by flowing the hot, cleaned gases through a second heat exchanger. The hot gases heat the heat exchange materials in the second heat exchanger. After the heat exchange material has been heated in this manner, the flow of incoming VOC-laden gases is redirected such that it moves through the heat exchange material in the second heat exchanger, and to the combustion chamber. Valving systems control the alternate flow of the gases through the heat exchangers. In this manner, the incoming gases are preheated.

Commercial systems of this type process extremely large volumes of gases. The individual heat exchangers may process a volume from about 7,000 to several hundred thousand cubic feet per minute. In order to preheat the large volume of gas (and to extract heat from the gas) a corresponding volume of heat exchange material is needed to pack the chambers. In a typical regenerative incinerator, the heat exchange material in a single heat exchanger may have a mass in excess of 65,000 pounds.

In conventional regenerative incinerators, the heat exchange material is supported in each chamber by a grate which defines a region of space beneath it. Gases flow between the space and the combustion chamber through the heat exchange material. This allows for relatively even flow and distribution of the gases through the heat exchange material and prevents any obstruction of the inlet/outlet port by the heat exchange material.

This method of supporting heat exchange material on a grate has one important drawback. Due to the massive weight of the heat exchange material, the grate may sag and/or detach from the side walls of the heat exchange chambers. This allows the heat exchange material to flow downwardly into the bottom of the heat exchanger, and interfere with the flow of gases through the port and with the even distribution of gases through the heat exchanger. The catastrophic failure of a grate results in downtime as well as considerable expense in association with the removal of the heat exchange material and repair of the grate. Thus, there exists a need for an alternative to the conventional grate supported heat exchange material in heat exchangers of regenerative incinerators. The present invention achieves this goal.

SUMMARY OF THE INVENTION

In one aspect of the present invention a grateless regenerative incinerator is disclosed having a common combustion chamber with a burner, and a plurality of heat exchange chambers, with one end of each heat exchange chamber being in flow communication with the common combustion chamber. A gas distribution assembly is mounted adjacent the bottom of each heat exchange chamber. The gas distribution assemblies each include a plurality of tubes. The tubes are each provided with a plurality of bores, and are configured to optimize gas flow through the heat exchange chamber. A known valving system controls flow to and from the gas distribution assemblies.

A coarse heat exchange material is added directly to the bottom of each heat exchange chamber, contacting and covering the tubes. A fine heat exchange material is added to each heat exchange chamber on top of the coarse heat exchange material, and fills the chamber in the customary manner. The heat exchange material and the gas distribution assembly are supported by the floor of the heat exchange chamber rather than by a suspended grate. By eliminating the suspended grate in this manner, the drawbacks of the prior art systems are eliminated.

These and other advantages and features of the present invention will be more fully described in the detailed description of the preferred embodiments of the invention with reference to the following drawings in which:

BRIEF DESCRIPTION OF THE DRAWINGS

FIG. 1 is an elevational view of a prior art regenerative incinerator partially in cross-section, and partially broken away.

FIG. 2 is a section taken along the line 2—2 as shown in FIG. 1.

FIG. 3 is an elevational view of a regenerative incinerator made in accordance with the present invention, partially broken away.

DETAILED DESCRIPTION OF THE PREFERRED EMBODIMENT OF THE INVENTION

Figure 4:
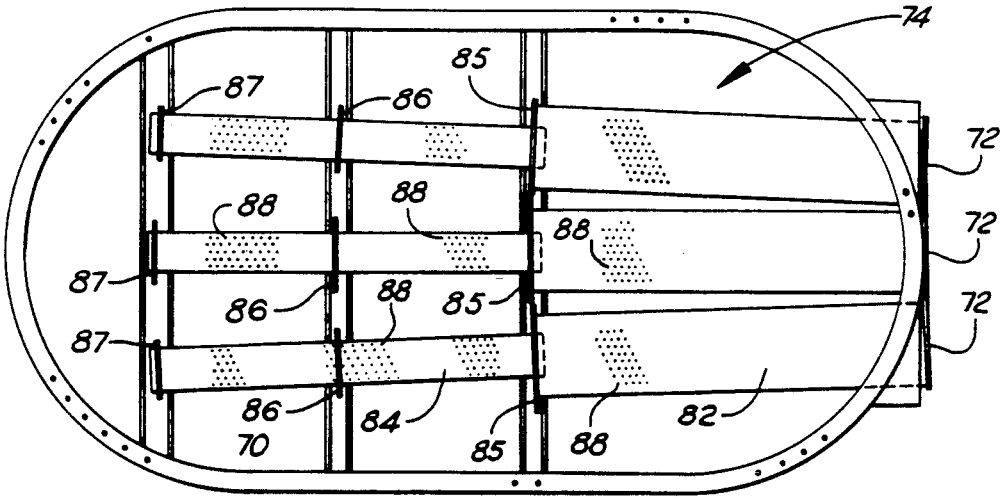
FIG. 4 is a section taken along line 4—4 as shown in FIG. 3.

In order to describe the advantages of the present invention, a prior art regenerative incinerator 20 is illustrated in FIG. 1. Regenerative incinerator 20 includes housing 22 which defines common combustion chamber 24, having gas burner 26. Three separate heat exchangers 30, 32 and 36 are attached at one end to housing 22, and in flow communication with chamber 24.

Heat exchanger 36, shown in cross-section, comprises an enclosure or housing 40 having floor 42, above which grate 44 is suspended. Grate 44 is typically formed of steel. A space 46 into which gases flow during operation is defined beneath grate 44. The gases flow through a port similar to port 48 shown on heat exchanger 32. Heat exchange material 50, which may comprise a number of materials such as pebbles, ceramic saddles, or similar materials, is supported on grate 44. Gaseous streams flowing through regenerative incinerator 20 pass through heat exchange material 50 between combustion chamber 24 and space 46.

Referring to FIG. 2 of the drawings, grate 44 is shown in greater detail inside heat exchanger 36 and above port 48. Brackets support grate 44 in heat exchanger 36. The weight of heat exchange material 50 on grate 44 could potentially cause grate 44 to sag and/or become detached from housing 40. If grate 44 fails, heat exchange material 50 would fall to bottom 42 of heat exchanger 36.

A regenerative incinerator 54 made in accordance with the present invention is shown in FIG. 3. Incinerator 54 includes housing 56, which defines a common combustion chamber 58 with gas burner 60. A plurality of heat exchangers 62 are shown, the construction of which will be explained more fully below. Although three heat exchangers 62 are shown, other numbers may be used. One end of each heat exchanger 62 is in flow communication with chamber 58, and is attached to enclosure 56 by couplings 64. The general construction of regenerative incinerator 54, other than the structure within the heat exchanger chambers, may be similar to the regenerative incinerators described in U.S. Pat. No. 4,470,806 entitled, "Regenerative Incinerators". The entire disclosure of the U.S. Pat. No. 4,470,806, including the drawings, is incorporated herein by reference.

Still referring to FIG. 3 of the drawings, heat exchangers 62 each comprise a housing or enclosure 66 which defines a chamber 68. Each enclosure 66 has floor 70, and a plurality of ports 72 for the passage of gases into and out of chamber 68. A heat exchange material fills chamber 68, as will be described below.

Referring to FIG. 4 of the drawings, gas distribution assembly 74 is positioned adjacent floor 70 of each heat exchanger 66. Gas distribution assembly 74 includes a plurality of separate tubes 76, 78 and 80. Each tube 76, 78 and 80 consists of a first greater diameter tube part 82, which is connected to a second smaller diameter tube part 84. Support plates 85, 86 and 87 support tubes 76, 78 and 80 at spaced locations along their length. Bores 88 are formed in tube parts 82 and 84. A manifold, not illustrated, communicates with ports 72. The manifold also communicates through a known valving system with both a source of gas to be cleaned, and an outlet for delivery of cleaned gas.

Smaller diameter second tube part 84 reduces the size of a slug of a dead air which may be trapped at the end of the tube as the system changes cycles between inlet and outlet modes. Preferably, the diameter of bores 88 in second tube part 84 is greater than the diameter of bores 88 in first tube part 82. This maintains the flow area per unit length along the tube relatively constant, even though the diameter of second tube part 84 is smaller, and thus there are less bores in number. Since tubes 76, 78 and 80 are positioned on brackets 85, 86 and 87 slightly above floor 70, bores 88 are formed through 360 degrees of the tubes.

A number of materials may be used to form gas distribution assembly 74. Tubes 76, 78 and 80 may be rolled from perforated steel sheets. Alternatively, it may be possible to cast assembly 74 as a single piece of cast iron, or to weld the various elements together to form the assembly. Similarly, conventional pipes and pipe fittings may be used to fabricate gas distribution assembly 74. In such embodiments bores 88 may be drilled into the tubes. The number of tubes will vary depending upon the particular application. It is anticipated that 1 to about 4 tubes will be appropriate for most applications. Similarly, the dimensions of the various components or elements of gas distribution assembly 74 may vary greatly; however, it is anticipated that from about 6" to about 36" diameter steel pipe would be suitable in most instances for tubes 76, 78 and 80. Bores 88 preferably have a diameter of from about ½" to about 2" inches.

Figure 5:
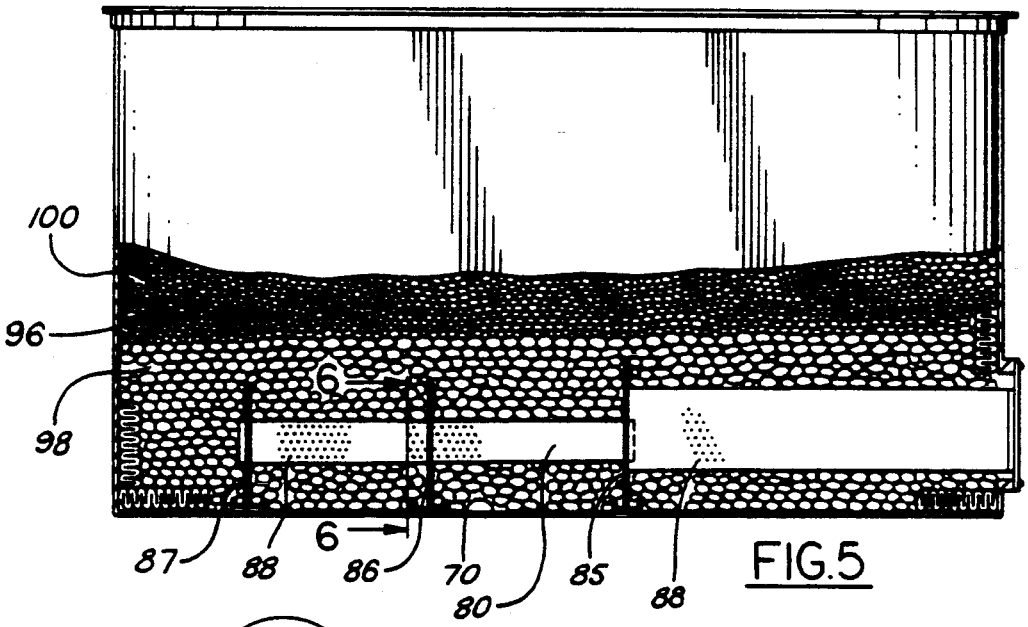
FIG. 5 is a cross-sectional view through one end of the section illustrated in FIG. 4.

Referring to FIG. 5 of the drawings, an important aspect of the present invention is the selection and arrangement of heat exchange material 96. Heat exchange material 96 includes a coarse material 98 and a fine material 100. It is important that the material which is in contact with gas distribution assembly 74 have a geometry which, when packed, does not obstruct the flow of gas into or out of bores 88. Suitable material would generally be relatively large diameter heat exchange saddles or pebbles which pack loosely, i.e. which define relatively large interstices through which gases may flow.

Where coarse heat exchange material 98 is generally spherical in nature, it is preferred that the average particle size of the coarse heat exchange material 98 be from about 3" to about 5". Most preferably, the coarse heat exchange material 98 comprises ceramic saddles having an average size of from about 3 inches. One suitable material is available under the trade name Flexidles TM. Other materials may be suitable in a particular application.

Coarse material 98 is loaded directly onto gas distribution assembly 74 and contacts floor 70 of heat exchange chamber 68, and between and around tubes 76, 78 and 80. The depth of coarse material 98 may vary, but at a minimum it should be sufficient to support fine material 100, such that fine material 100 does not flow downwardly into the interstices defined by heat exchange material 98 adjacent bores 88. In other words, it should be sufficient to prevent fine material 100 from obstructing bores 88. The fine material is preferably formed of the same materials as coarse material 98, but of a smaller average particle size. When fine material 100 comprises generally spherical pebbles, an average diameter of from about ¾" to about 1 ½" is preferred.

The remainder of chamber 68 above material 98 will generally be filled with heat exchanger material 100. It will be recognized that fine material 100 has a greater heat exchange capacity than coarse material 98 due to the increased surface area to volume ratio.

Figure 6:
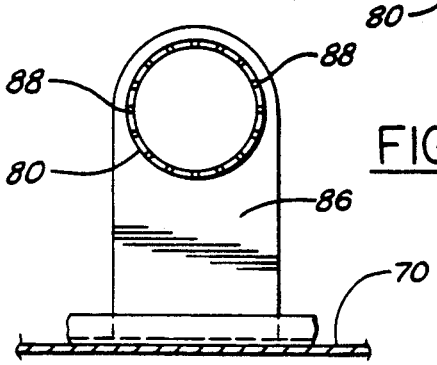
FIG. 6 is a section taken along line 6—6 as shown in FIG. 5.

As shown in FIG. 6, bores 88 are preferably spaced about the entire outer circumference of tube 80. This ensures maximum flow volumes being treated by each heat exchange chamber.

In operation, and referring to FIGS. 3 and 5, a VOC-laden gas is introduced through a series of manifolds (not shown) to ports 72 and then flows into tubes 76, 78 and 80. The VOC-laden gas then flows through bores 88 and upwardly through heat exchange material 96 into combustion chamber 58 of regenerative incinerator 54. The VOC-laden gases then pass through a combustion flame generated by burner 60, whereby substantial VOC destruction occurs. The resulting hot, purified gases flow downwardly through one or both of the other heat exchange chambers 62 and give off heat to the heat exchange material within the other chambers. The purified gas is thus cooled.

The cooled purified gas exits the heat exchange chambers by passing into bores 88, and then out through their respective ports 72. Following this cycle, the VOC-laden gases entering regenerative incinerator 54 are shunted to a heat exchange chamber in which the heat exchange material has been heated by the previous cycle. The incoming gases are heated to a temperature near their ignition temperature prior to entering combustion chamber 58. In this manner, significant energy savings are achieved. The valving structure necessary to direct the various gases in sequence is not critical to the present invention, and may be similar to that shown in U.S. Pat. No. 4,470,806.

Thus, it is apparent that there has been provided in accordance with the invention a method and apparatus that fully satisfies the objects, aims and advantages set forth above. While the invention has been described in connection with specific embodiments thereof, it is evident that many alternatives, modifications, and variations will be apparent to those skilled in the art in light of the foregoing description. Accordingly, the invention is intended to embrace all such alternatives, modifications and variations that fall with the spirit and broad scope of the appended claims.

What is claimed is:

1. A regenerative incinerator comprising:

an enclosure defining a common combustion region;

a burner in association with said enclosure positioned to create a flame which extends into said common combustion region;

a plurality of heat exchange chamber, one end of each of said heat exchange chamber being in flow communication with said common combustion region;

a plurality of gas distribution assemblies, at least one of said gas distribution assemblies being positioned in each of said heat exchange chambers at the other end of said heat exchanger chambers, said gas distribution assembly including a valve, and said gas distribution assembly being connected to a source of air to be cleaned, and an exhaust for cleansed air, said valve alternatively connecting said gas distribution assembly to said source of air to be cleaned and said exhaust;

each of said gas distribution assemblies having at least two tubes for the flow of gas therethrough; and a heat exchange material disposed in each of said heat exchange chambers between said one end and said other end of each of said heat exchange, chambers and in contact with said tubes.

2. The incinerator recited in claim 1, wherein said heat exchange material comprises a first layer of relatively coarse heat exchange material in contact with said tubes and a second layer of relatively fine heat exchange material disposed on top of said first layer and having an average particle size smaller than that of said coarse heat exchange material.

3. The incinerator recited in claim 2, wherein said heat exchange materials comprises ceramic saddles.

4. The incinerator recited in claim 1, wherein each of said tubes comprises a first greater diameter tube portion communicating with a port in an outer wall of said heat exchange chamber, said first greater diameter tube portion being connected to a second smaller diameter tube portion which extends away from said first portion further into said heat exchange chamber.

5. The incinerator recited in claim 4, wherein each of said tubes have a plurality of bores spaced about their entire outer circumference, said bores formed in said first greater diameter tube portion being of a smaller diameter than said bores which are formed in said second smaller diameter tube portion.

6. The incinerator recited in claim 1, wherein each of said tubes are supported off of a floor of said heat exchange chamber, and said tubes having a plurality of bores spaced about their entire outer circumference.

7. A heat exchange comprising:

a housing defining a heat exchange chamber;

a gas distribution assembly positioned at one end of said heat exchange chamber;

said gas distribution assembly having at least two tubes for the flow of gas therethrough, each of said two tubes having a plurality of orifices for the flow of gases therethrough;

a heat exchange material disposed in said heat exchange chamber in contact with said tubes; and each of said tubes having a first greater diameter tube portion communicating with a port in an outer wall of said heat exchange chambers, and a second smaller diameter tube portion connected to and extending from said first tube portion.

8. The incinerator recited in claim 7, wherein said heat exchange material comprises a first layer of relatively coarse heat exchange material in contact with said tubes and a second layer of relatively fine heat exchange material disposed on top of said first layer and having an average particle size smaller than that of said coarse heat exchange material.

9. The heat exchanger recited in claim 7, wherein each of said tubes are supported slightly off a floor of said heat exchange chamber, and said orifices are formed through an outer peripheral wall of said tubes, and spaced over their entire outer circumference.

10. A regenerative incinerator, comprising:

an enclosure defining a common combustion region;

a burner positioned to create a flame which extends into said common combustion region;

a plurality of heat exchanger chambers;

one end of said heat exchange chambers being in flow communication with said common combustion region;

a plurality of gas distribution assemblies, at least one of said gas distribution assemblies being positioned in each of said heat exchange chambers at the other end of said heat exchanger, and having at least two tubes for the flow of gas, each of said two tubes having a plurality of orifices for the flow of gases therethrough; and each of said tubes being supported slightly off a floor of said heat exchange chamber, and said orifices being formed through an outer peripheral wall of said tubes, and spaced over their entire outer circumference.

11. The incinerator recited in claim 10, further including a heat exchange material disposed in each of said heat exchange chambers and in contact with said tubes, said heat exchange material being positioned between said one end and said other end of each of said heat exchanger chambers.

12. The incinerator recited in claim 11, wherein said heat exchange material comprises a first layer of relatively coarse heat exchange material in contact with said tubes and a second layer of relatively fine heat exchange material disposed on top of said first layer and having an average particle size smaller than that of said coarse heat exchange material.

13. The incinerator recited in claim 11, wherein said heat exchange material includes ceramic saddles.

14. The incinerator recited in claim 10, wherein each of said tubes consist of a first greater diameter tube portion communicating with a port in an outer wall of said heat exchange chambers, and a second smaller diameter tube portion connected to, and extending from said first tube portion.

15. A method of VOC destruction in a VOC-laden gaseous stream, comprising the steps of:

introducing a VOC-laden stream into a first heat exchanger by way of a gas distribution assembly having at least two tubes for the flow of gas therethrough, each of said two tubes having a plurality of bores for the flow of gases therethrough;

flowing said VOC-laden gases through said bores into a heat exchange material packed in said heat exchanger in contact with said gas distribution assembly, and to a combustion chamber in flow communication with one end of said heat exchanger, said combustion chamber having a combustion flame positioned therein such that said VOC-laden gas stream is purified by combustion of said VOCs by said flame to produce a hot, purified gas stream;

flowing said hot, purified gas stream through a second heat exchanger and through a heat exchange material packed in said second heat exchanger, such that said heat exchange material in said second heat exchanger is heated by said hot, purified gases; and flowing said purified gas stream through a second gas distribution assembly positioned in said second heat exchanger, said second gas distribution assembly having at least two tubes for the flow of gas therethrough, each of said two tubes having a plurality of orifices for the flow of gases therethrough, said flowing of said purified gas through said second gas distribution assembly being through said orifices into said tubes and then out of said gas distribution assembly.

16. The method recited in claim 15, wherein said heat exchange material comprises a layer of coarse material in contact with each of said gas distribution assemblies and a layer of fine material on top of said coarse material, said fine material having an average particle size less than the average particle size of said coarse material.

17. A regenerative incinerator comprising:

an enclosure defining a common combustion region;

a plurality of heat exchange chambers, one end of each of said heat exchange chambers being in flow communication with said common combustion region;

a plurality of gas distribution assemblies, with one of said gas distribution assemblies being associated with each of said heat exchange chambers, said gas distribution assemblies adapted to selectively communicate a source of air to be combusted to said common combustion region through one of said heat exchange chambers, and receive previously combusted air from said common combustion region through a second of said heat exchange chambers;

each of said heat exchange chambers containing heat exchange material, said gas distribution assemblies comprising at least one tube extending into said heat exchange chamber, said heat exchange material being in contact with said at least one tube, said heat exchange material comprising a first material in contact with said at least one tube, said at least one tube having bores at its outer periphery for flow of gas, the diameter of said bores being smaller than the average particle size of said first material; and said first material comprising a first layer of relatively coarse heat exchange material in contact with said tubes, said heat exchange material also comprising a second layer of relatively fine heat exchange material having an average particle size smaller than that of said coarse heat exchange material, said fine heat exchange material being disposed on a side of said first layer removed from said at least one tube.

* * * * *